United States Patent [19]

Toner

[11] Patent Number: 4,912,906

[45] Date of Patent: Apr. 3, 1990

[54] AUTOMATIC BAG SYSTEM FOR SUPERMARKET CHECK-OUT COUNTER

[76] Inventor: Frank T. Toner, 2138 Andrea Dr., Bensalem, Pa. 19020

[21] Appl. No.: 351,655

[22] Filed: May 15, 1989

[51] Int. Cl.[4] ..... B65B 47/04; B65B 11/16; B65B 11/54; B65B 67/00

[52] U.S. Cl. ..... 53/463; 53/464; 53/466; 53/222; 53/229; 53/390; 186/59; 186/66

[58] Field of Search ..... 53/464, 466, 222, 219, 53/390, 228, 229, 463; 186/59, 66

[56] References Cited

U.S. PATENT DOCUMENTS

| | | | |
|---|---|---|---|
| 2,265,636 | 12/1941 | Eaton | 53/222 X |
| 2,808,127 | 10/1957 | Wesberry | 186/66 X |
| 2,883,004 | 4/1959 | Bellino | 186/66 X |
| 3,025,651 | 3/1962 | Stanley | 53/390 X |
| 3,054,238 | 9/1962 | Crane | 53/390 X |
| 3,354,600 | 11/1967 | Hoffmann | 53/464 X |
| 3,404,507 | 10/1968 | Feigel et al. | 53/390 X |
| 3,432,988 | 3/1969 | Minten | 53/229 |
| 3,533,207 | 10/1970 | Freemantle et al. | 53/222 X |
| 3,792,565 | 2/1974 | Goransson | 53/390 X |
| 3,820,304 | 6/1974 | Bailey | 53/219 X |
| 3,994,114 | 11/1976 | Nishimura | 53/229 X |

*Primary Examiner*—Horace M. Culver
*Attorney, Agent, or Firm*—Steele, Gould & Fried

[57] ABSTRACT

An automatic bag system for supermarket check-out counters is disclosed. An open top loading compartment is provided adjacent to the check-out clerk and a roll of plastic material is mounted to feed sheet plastic over the open top of the loading compartment. The loading compartment is provided with transversely opposed vertical slots and guide rollers rotatively secured at the top of the slots. Upon loading purchased items into the loading compartment above the plastic material, the plastic material will be urged interiorly of the loading compartment and will assume the shape of the compartment interior configuration. The guide rollers and the vertical slots cooperate to form left and right vertical seams in the plastic material as the compartment is loaded. The left and right seams are heat sealed upon completion of the loading operations to form a finished plastic package with the purchased items contained therewithin.

17 Claims, 2 Drawing Sheets

AUTOMATIC BAG SYSTEM FOR SUPERMARKET CHECK-OUT COUNTER

BACKGROUND OF THE INVENTION

1. Field of the Invention

This invention relates generally to the field of supermarket merchandise check-out systems, and particularly, relates to a supermarket check-out counter incorporating means to automatically envelop purchased items within a plastic bag at the time of check-out.

2. Discussion of the Prior Art

Supermarket type stores have long been popular in the United States and elsewhere wherein a large volume of groceries and other items have been assembled within a single structure for low-cost vending to a great number of purchasers. It is contemplated that most customers will purchase considerable quantities of fruits, vegetables and packaged items during each visit to the supermarket and accordingly, elongated check-out counters have been developed by prior workers in the art. This enables the shopper to unload the items to be purchased upon the counter from a shopping cart in order to allow a clerk to check each item and to calculate the total bill for the entire purchase.

Various types of check-out counters have been designed and these prior art check-out counters include improvements and work-saving features such as conveyor belts, laser scanners, automatic weighing devices and the like. While the various construction features may vary from counter to counter, it is an inherent operation at each check-out counter that the merchandise purchased must be placed into some type of container to allow the customer to easily remove the purchased materials from the supermarket upon completion of the transaction. Accordingly, so far as is known to the present applicant, each check-out counter includes some type of packaging facility to permit the check-out clerk to place the purchased items within one or more plastic or paper bags. The loading of the numerous purchased articles by the clerk into the individual bags requires a considerable amount of time and effort on the part of the clerk, thereby slowing down the check-out procedure and increasing labor costs to the operators of the supermarkets.

Numerous workers in the art have attempted to improve the bagging and check-out procedures, but to date, despite these improvements, the loss of time at the check-out counter remains a major problem that must be overcome. Sparks, U.S. Pat. No. 3,696,586 shows a bagging and check-out counter system having a flat deck and which is provided with a bag dispenser. Schohl, U.S. Pat. No. 3,715,862 shows a check-out counter which includes a vacuum system to automatically hold a bag open to allow the clerk to load the bag.

Chesnut, U.S. Pat. No. 3,860,091 shows a supermarket check-out counter having an automatic bagging arrangement to facilitate the bag loading operations. Nestler, U.S. Pat. No. 3,512,338 teaches a supermarket check-out counter wherein a plurality of sheet plastic bags are maintained in nested condition and wherein the bags are formed from a roll of sheet plastic material. Busch, U.S. Pat. No. 4,484,662 teaches the use of a bag handling apparatus at the check-out counter which is designed to hold the mouth of the bag open for loading purposes.

Despite these and other efforts by prior workers in the field to enhance the supermarket check-out system, the need remains to provide an improved apparatus which is capable of filling or loading a container in a manner to save the time of the counter clerk.

SUMMARY OF THE INVENTION

The present invention relates generally to automatic bagging systems for use at supermarket check-out counters, and more particularly, relates to a plastic film feed system and supporting structure which is designed to form portions of the sheet plastic into a bag or container as purchased articles are loaded upon the film and heating means to cut and seal the plastic film into a non-rigid container suitable to contain and carry the purchased items.

The automatic bag system of the present invention is designed for installation at the cash register end of a supermarket check-out counter and comprises generally a large roll of flexible, heat sealable film, such as polyethylene film, which is mounted for rotation to feed the film to a loading station. The leading edge of the film is manually advanced by hand over the top opening of a loading compartment or shell to an easily operable film holding clamp. Pairs of left and right guide rollers are transversely positioned medially of the shell or loading compartment and serve as left and right edge guides for the film as the purchased items are introduced into the loading compartment above the film.

Preferably, the shell or loading compartment is equipped with a movable, spring-loaded, telescoping floor wherein the floor is normally spring biased toward the upper opening of the shell or loading compartment. Accordingly, the floor serves to support the film at the top of the shell until such time as groceries and other items are inserted into the upper end of the shell for loading purposes. As the weight of the purchased items increases, the bias of the supporting spring will be increasing overcome whereby the floor will automatically lower into the shell as the purchased item loading procedures continue. As the floor of the loading compartment is increasingly depressed by the weight of the loaded groceries, the film will be drawn into the loading compartment below and around the loaded items in a manner to completely enclose or encircle the purchased items. Thus, the shell will function as a mold or form to shape the sheet plastic film into a container with the purchased items automatically contained therein.

During the compartment loading process, the left and right pairs of guide rollers function to align portions of the left and right film areas in linear contact in a manner to form the left and right seams of a subsequently to be formed, plastic, article holding package.

When the loading compartment or shell has been sufficiently loaded to completely depress the telescoping floor, either by weight or by volume, a movable sealer assembly can be manually or automatically functioned to cooperate with left and right stationary heat sealing elements to seal the left and right linear seams which are formed during the compartment loading process. A cut-off block which may be manually or automatically actuated functions in coordination with a conventional heating element to sever the film rearwardly of the package upon completion of the loading operation. The completed package, with all of the loaded items contained therewithin can then be manually removed from the shell or loading compartment by grasping upper portions of the package which remain after the cut-off operations. In this manner, the check-out clerk can price each item and then individually load the groceries and other purchased items onto a plastic film for subsequent forming into a package or container, thereby freeing the clerk from all of the previously required chores of securing a plastic or paper bag, opening the bag, maintaining the bag in an open condition for loading purposes and then finally loading each bag in turn with the purchased items. The automatic bag system of the present invention frees the check-out clerk from all of these previously required, time consuming operations, thereby speeding up and increasing the efficiency of the supermarket check-out system.

It is therefore an object of the present invention to provide an improved automatic bag system for supermarket check-out counters.

It is another object of the present invention to provide a novel automatic bag system for supermarket check-out counters including an upwardly open shell or loading compartment positioned for easy access by the check-out clerk, a film system comprising a roll of plastic film and means to spread a portion of the plastic film over the open top of the loading compartment, means to guide the lateral edges of the film into linear seams as items are introduced into the loading compartment over the film, and heating means to seal the left and right linear seams upon completion of the loading operation to thereby automatically form a plastic bag or package about the loaded items in a manner suitable for transporting the purchased items away from the supermarket within the formed package.

It is another object of the present invention to provide a novel automatic bag system for supermarket check-out counters comprising loading compartment means having a spring-biased elevating floor and an open top, film roll means positioned rearwardly of the loading compartment in a manner to allow plastic film to be fed over the open top of the loading compartment, clamping means positioned forwardly of the loading compartment to secure the leading edge of the plastic film during the loading process, left and right guide rollers positioned transversely and medially of the loading compartment, the guide rollers guiding the lateral edges of the film into left and right linear seams as the purchased items are loaded into the loading compartment, left and right heat sealing means to seal the left and right linear seams upon completion of the loading process and heated cut-off means positioned rearwardly of the loading compartment to sever the plastic film upon completion of the loading operations, whereby an item containing plastic bag or package can be automatically formed as the purchased items are introduced upon a portion of the plastic film.

It is another object of the present invention to provide a novel automatic bag system for supermarket check-out counters comprising film means for feeding sheet plastic materials to a shell or loading compartment, package forming means to form the sheet plastic into a container or package upon introduction of a plurality of purchased items, heat sealing means to seal the lateral edges of the sheet plastic film upon completion of the filling operations and sheet plastic severing means to cut the sheet plastic upon formation of the article holding bag or package.

It is another object of the present invention to provide a novel automatic bag system for supermarket check-out counters that is simple in design, trouble-free in operation and highly efficient when in use.

Other objects and a fuller understanding of the invention will be had by referring to the following description and claims of a preferred embodiment, taken in conjunction with the accompanying drawings wherein like referenced characters refer to similar parts throughout the several views and in which:

DESCRIPTION OF THE PREFERRED EMBODIMENT OF THE INVENTION

Figures 1, 2:
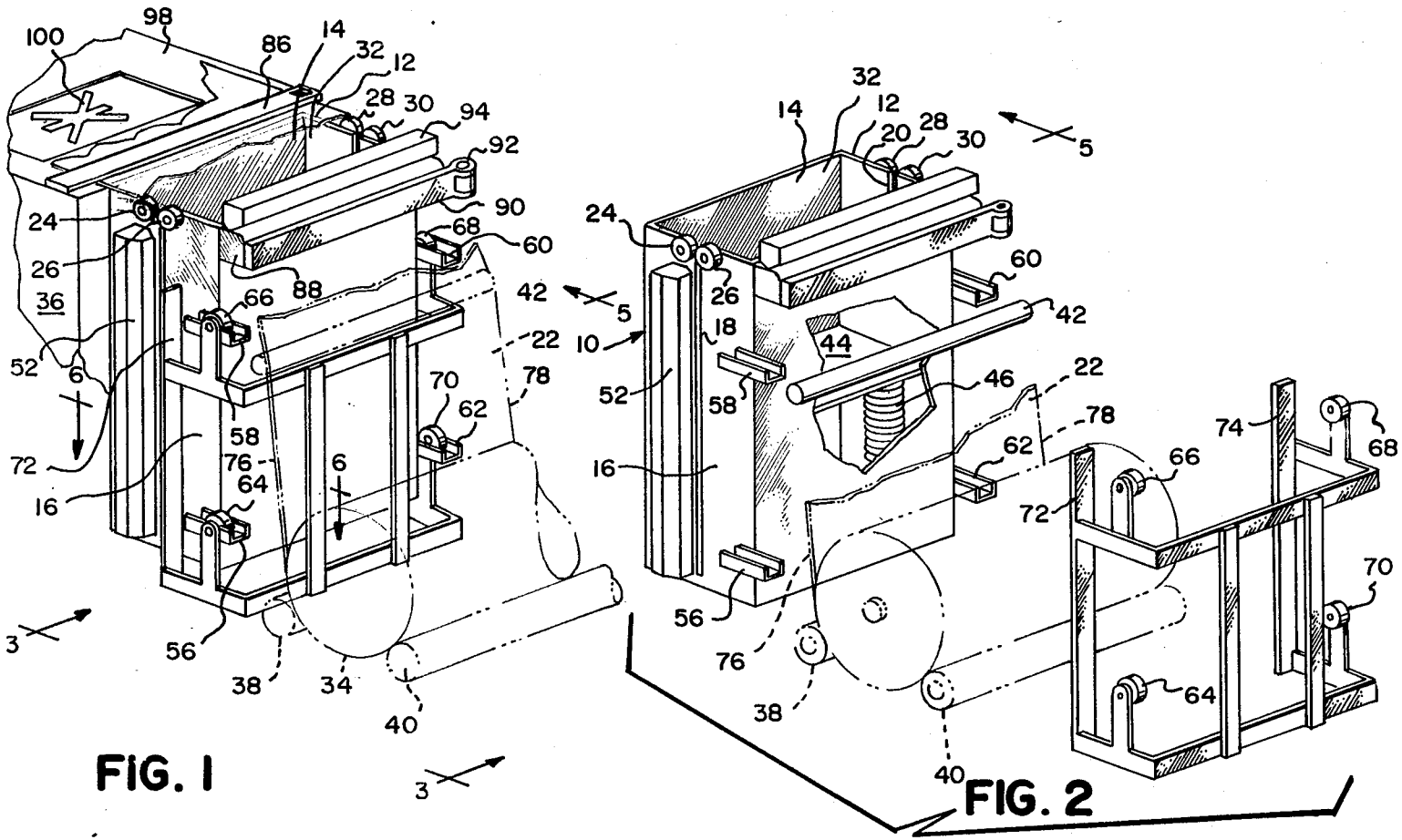
FIG. 1 is a perspective view of the automatic bag system for a supermarket check-out counter constructed in accordance with the present invention.
FIG. 2 is a perspective view similar to FIG. 1, partially exploded and partially broken away to expose interior construction details.

Although specific terms are used in the following description for the sake of clarity, these terms are intended to refer only to the particular structure of the invention selected for illustration in the drawings, and are not intended to define or limit the scope of the invention.

Referring now to FIGS. 1 and 2, there is illustrated an automatic bag system 10 for supermarket check-out counter 36 which comprises generally a shell or loading compartment 12 which is preferably rectangular in configuration and which is formed of a pair of opposed, channel-shaped half sections 14, 16 to provide an area for grocery loading in the manner hereinafter more fully set forth. The loading compartment half sections 14, 16 define therebetween opposed, similar, medial, vertical slots 18, 20. The slots 18, 20 are designed and intended to receive the transverse side portions or edges 76, 78 of the plastic film 22 therewithin for side seam forming purposes in the manner hereinafter more fully explained.

Figures 3, 4, 5, 6, 7:
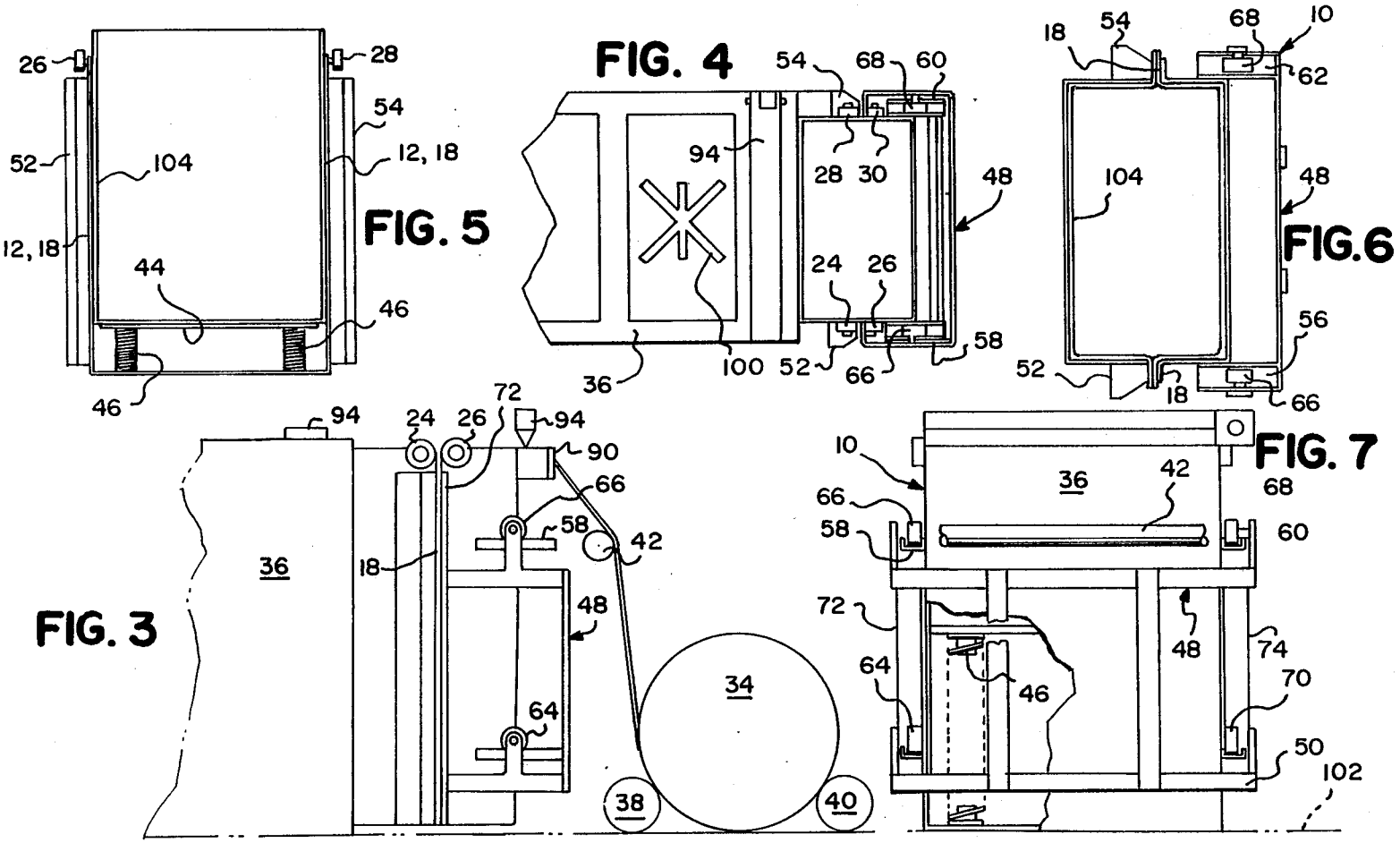
FIG. 3 is a side elevational view of the automatic bag system, looking from line 3—3 on FIG. 1 in the direction of the arrows.
FIG. 4 is a top plan view looking from line 4—4 on FIG. 3 in the direction of the arrows.
FIG. 5 is an end elevational view of the automatic bag system looking from line 5—5 on FIG. 4, and partially broken away to expose interior construction details.
FIG. 6 is a cross sectional view looking from line 6—6 on FIG. 3.
FIG. 7 is a cross sectional view looking from line 7—7 on FIG. 1.

Opposed pairs of upper guide rollers 24, 26 and 28, 30 are rotatively carried by the shell half sections 14, 16 near the open top 32 thereof in a manner whereby the upper peripheries of the rollers 24, 26, 28, 30 extend slightly above the open top 32 of the loading compartment 12 for film guiding purposes. As best seen in FIGS. 2 and 3, a roll 34 of the plastic film 22 is positioned for rotation rearwardly of the check-out counter 36 to readily feed a length of plastic film 22 to cover the open top 32 of the shell or loading compartment 12 for grocery loading and bagging purposes in the manner hereinafter more fully set forth. A pair of idler rollers 38, 40 rotatively support the roll 34 of plastic film 22 to allow a leading portion of the film to be readily introduced over the loading compartment 12 for package loading purposes. If desired or bound necessary an upper idler roller 42 can be rotatively positioned in a convenient location to facilitate the application of the plastic film 22 to the automatic bag system 10.

An elevating type table plate or loading floor 44 is positioned within the interior of the shell 12 and is maintained generally below the open top 32 for receipt and support of groceries and other purchased items thereon. One or more coil springs 46 extend between the floor 102 (FIG. 5) of the automatic system 10 and the underside of the table plate 44 to continuously bias the table plate 44 upwardly toward the shell open top 32. The table plate 44 is vertically movable within the interior of the shell 12 so that the weight of the groceries and other purchased items (not shown) will cause the table plate or loading floor 44 to automatically descend within the shell 12 in response to the added weight. When the loading floor 44 is depressed to a desired or predetermined height within the shell 12, the automatic bag constructed in accordance with the teachings of the present invention can then be formed about the purchased items to automatically bag the same ready for removal from the shell and for carrying from the supermarket.

Referring now to FIGS. 3, 4 and 5, and still considering FIG. 2, the side seam sealing assembly 48 comprises generally a movable pressing assembly 50 in cooperating, movable engagement with the stationary left and right heating and sealing elements 52, 54. The left and right heating and sealing elements 52, 54 preferably are of type well known to those skilled in the art and have sufficient applied wattage in known matter to cause sealing of the left and right side seams as the side seams are formed during the loading and packaging operations. A plurality of guide channels or rails 56, 58, 60, 62 horizontally extend rearwardly from the loading compartment half section 16 to guide and rotatively receive thereon the plurality of pressing assembly guide rollers 64, 66, 68, 70. Accordingly, the side seam sealing assembly 48 is movable toward and away from the left and right heating and sealing elements 52, 54 along the plurality of guide channels or rails 56, 58, 60, 62.

Preferably, a hand lever or operator (not shown) can be conveniently positioned for manual operation by the check-out clerk (not illustrated) to facilitate movement of the side seam sealing assembly 48 toward and away from the heating and sealing elements 52, 54. Optically, the side seam sealing assembly 48 could be motorized or otherwise powered for automatic reciprocal operation relative to the left and right heating and sealing elements 52, 54 in known manner. The side seam sealing assembly 48 forwardly carries a transversely spaced pair of left and right, vertical pressing plates 72, 74 which are positioned and arranged to be brought into substantially overall vertical contact with the rearward faces of the left and right heating and sealing elements 52, 54. Accordingly, after the groceries and other purchased items have been loaded into the loading compartment or shell 12 whereby the weight of these items will cause the table plate 44 to vertically drop within the shell 12 and the film 22 to depress within and to be formed by the shell 12, the lateral edges 76, 78 of the film 22 will be urged downwardly within the left and right vertical slots 18, 20 upon action of the plurality of left and right upper guide rollers 24, 26, 28, 30. The guide rollers automatically function to define or form left and right vertical seams 80, 82 immediately rearwardly of the left and right heating and sealing elements 52, 54. Then, by urging the left and right pressing plates 72, 74 against the left and right heating and sealing elements 52, 54 with the left and right vertical seams of the plastic film squeezed therebetween, either manually or automatically in known manner, upon activation of the left and right heating and sealing elements 52, 54, the left and right vertical seams 80, 82 will then be heat sealed in usual manner to form a plastic package 104 about the loaded purchased items (not illustrated).

Referring still to FIGS. 2, 3, 4 and 5, a forward film holding clamp 84 is manually or automatically pivotal about the upper hinge 86 from a clamping position in contact with a portion of the check-out counter 36 (as illustrated in FIG. 5) to an elevated position wherein the forward edge of the plastic film can be manually applied to the film holding clamp 86.

A cut-off heating element 94 of conventional design rearwardly secures to an upper portion of the rear shell half section 16 in position to be contacted by a portion of the film 22 during the package fabrication procedures. Upon completion of loading the purchased items into the loading compartment 12, the film will settle downwardly to form the plastic package 104 within the loading compartment 12. As hereinafter mentioned, as the plastic film 22 is caused to be molded or formed within the shell 12, the left and right vertical seams 80, 82 will be defined within the left and right vertical slots 18, 20. The side seam sealing assembly 48 can then be brought forwardly by the interaction of the guide rollers 64, 66, 68, 70 within the rails 56, 58, 60, 62 until the left and right pressing plates 72, 74 press the left and right vertical seams 80, 82 tightly against the left and right heating and sealing elements 52, 54. Upon activation of the left and right heating and sealing elements 52, 54, the left and right vertical seams can be heat sealed in known manner by permanently deforming the left and right edge portions of the film at the vertical slots 18, 20, thereby forming the finished carrying bag or container 104 about the purchased items. Then, the second film holding clamp 90 can be manually or automatically rotated about its hinge 92 to transversely secure a trailing portion of the film at the cut-off heating element 88. The cut-off block 94 can then be manually or automatically lowered to apply transverse pressure against the film and the cut-off heating element 88 can be electrically activated to thereby sever the film 22 in well known manner at the heating element 88. The completed package 104 containing the loaded purchased items can then be removed from the shell or loading compartment 12 by simply lifting the package for subsequent removal from the supermarket.

The system can then be readily prepared for the next loading operation by rotating and opening the film holding clamp 20 about the hinge 92 and by simultaneously grasping the free end of the plastic film 22. Then, by raising the cut-off block 94 and rotating the film holding clamp 84 about its hinge 86, the newly formed leading edge of the plastic film sheet can be secured to the automatic bagging system 10 in position to receive the next load of items to be packaged.

In order to use the automatic bag forming system 10 of the present invention, a roll 34 of suitable plastic film 22, for example 1½ mil polyethylene plastic film can be rotatively positioned upon the first and second idler rollers 38, 40. The free or forward edge 96 of the plastic film 22 can then be manually grasped by the check-out clerk (not illustrated) and pulled forwardly over the upper idler roller 42 until a portion of the film forward edge 96 rests upon the portion of the check-out counter 36 which is positioned immediately below the forward film holding clamp 84. The film holding clamp 84 can then be rotated about its hinge 86 to clamp the forward edge of the plastic film to the check-out counter 36 forwardly of the shell or loading compartment 12.

With the forward edge of the plastic film thus secured and with the film roll 34 free to rotate to release additional portions of the plastic film, the existing check-out counter conveyor 98 can be functioned to bring the items to be purchased into the reach of the check-out clerk (not shown) in the usual manner. Each item can be individually applied to a conventional scanner 100, if such a scanner is employed, or else can be manually read and the price applied to the cash register in known manner. The check-out clerk then places each item in turn into the open top 32 of the loading shell 12 with the plastic film 22 positioned intermediate the loaded item and the table plate or loading floor 44. The weight of the applied purchased items will cause the coil spring 46 to depress, thereby de-elevating the position of the table plate 44 relative to the check-out counter 36. The lowering of the table plate 44 will in turn allow the plastic film 22 to become depressed within the confines of the loading compartment 12 as defined by the forward and rearward component half sections 14, 16.

As the film 22 is additionally depressed within the loading compartment 12, the left and right transverse edges 76, 78 of the sheet of plastic film 22 will ride over the plurality of guide rollers 24, 26 and 28, 30 down into the left and right vertical slots 18, 20. The application of additional purchased items into the loading compartment 12 will cause the spring 46 to be additionally compressed whereby the table plate 44 will continue to descend within the loading compartment. When the loading compartment 12 has been completely filed or has been filed sufficiently to receive all of the items to be packaged, the side seam sealing assembly 48 can be reciprocated forwardly, either manually or by some known type of powered operator whereby the left and right pressing plates 72, 74 will be urged against the left and right heating and sealing elements 52, 54 with the plastic film left and right vertical edges squeezed therebetween. The heating elements 52, 54 can then be activated in known manner to permanently seal the left and right vertical seams 80, 82 by partially melting the plastic material employing the applied heat in well known manner.

Once the left and right vertical seams 80, 82 have been permanently sealed, the formed plastic carrying container 104 can then be defined with the articles contained therein by moving the second film holding clamp 90 about its hinge 92 to thereby clamp the trailing edge of the package against the rearward cut-off heating element 88. With the plastic film thus clamped, the cut-off block 94 can be lowered into pressing contact with the heating element 88 with the film squeezed therebetween. Upon activation of the heating element 88, the film will be rapidly severed, thereby leaving the completed package ready for removal from the shell or loading compartment 12. In this manner, a formed package 104 can be produced automatically with the vended articles already contained therewithin, complete and ready for carrying from the supermarket.

After removal of a completed package, the rearward film holding clamp 90 can be opened about its hinge 92 whereby the clerk (not shown) can grasp the new forward edge 96 of the film plastic sheet 22, and, after raising the cut-off block 94, the forward film edge can then be secured at the forward film holding clamp 84 whereby the system will then be ready for repetitious use.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. An automatic bag system for use in conjunction with a supermarket check-out counter of the type comprising a clerk check-out station having a left side and a right side comprising a loading compartment affixed to the counter adjacent to the clerk check-out station, the loading compartment comprising an open top and enclosing walls, the walls being provided with a pair of transversely opposed, vertical slots;

a length of sheet plastic material adapted to overlie the open top of the loading compartment, the system further comprising clamping means to secure a portion of the sheet plastic material relative to the loading compartment; guide means positioned adjacent to the vertical slots to guide edge portions of the plastic material into the vertical slots as the loading compartment is loaded, the guide means and the vertical slots being adapted to form edge portions of the plastic sheet into left and right vertical seams, as the loading compartment is loaded, the said seams extending outwardly of the loading compartment;

left and right heating and sealing elements affixed exteriorly of the loading compartment immediately forwardly of the vertical slots, the heating and sealing elements being positioned to be rearwardly covered by the left and right vertical seams as the vertical seams are formed by the guide means; and a pressing assembly reciprocally movable toward and away from the loading compartment, the pressing assembly comprising first and second pressing plates, the first and second pressing plates being positioned to respectively press against the left and right heating and sealing elements when the pressing assembly is urged toward the loading compartment;

whereby energization or the heating and sealing elements will cause the left and right vertical seams to be heat sealed when the first and second pressing plates press the plastic material at the left and right seams against the heating and sealing elements.

2. The automatic bag system of claim 1 wherein the sheet plastic material comprises a rotatable plastic material containing roll mounted adjacent to the loading compartment, the roll feeding plastic material to the system in a continuous sheet, the sheet being adapted to be severed upon operation of the system.

3. The automatic bag system of claim 2 and idler rollers supporting the plastic material roll, the plastic material roll being readily rotatable upon the idler rollers.

4. The automatic bag system of claim 1 and a loading compartment table plate, the table plate being vertically movable within the loading compartment.

5. The automatic bag system of claim 4 and a coil spring biasing against the underside of the table plate, the table plate being depressed within the loading compartment upon the application of weighted items sufficient to overcome the bias of the spring.

6. The automatic bag system of claim 1 and a plurality of guide rails extending rearwardly from the loading compartment, the pressing assembly being reciprocally movable relative to the loading compartment upon the said guide rails.

7. The automatic bag system of claim 6 wherein the pressing assembly comprises a plurality of guide rollers, one said guide roller being positioned within each of the said guide channels to facilitate reciprocal movement of the pressing assembly relative to the loading compartment.

8. The automatic bag system of claim 1 and a cut-off heating element transversely positioned rearwardly of the loading compartment, the cut-off heating element comprising a cut-off heating element and as cut-off block, the cut-off block being adapted to squeeze a portion of the plastic film between the cut-off block and the cut-off heating element.

9. The automatic bag system of claim 8 and a rearward film holding clamp hingedly affixed to the cut-off heating element whereby a portion of the plastic film can be secured and clamped to the loading compartment after the film has been severed by the rearward cut-off heating element.

10. The automatic bag system of claim 1 wherein the guide means comprise a plurality of rollers, the rollers being rotatively mounted relative to the loading compartment to urge the edge portions of the plastic material into the said slots.

11. The automatic bag system of claim 10 wherein some of said rollers are positioned forwardly of the vertical slots and other of said rollers are positioned rearwardly of the said vertical slots.

12. The method of bagging a plurality of items at a supermarket check-out counter comprising securing a loading compartment to the rear of the check-out counter and providing the loading compartment with an open top and a pair of transversely opposed vertical slots;

positioning a portion of a length of plastic sheet material over the open top of the loading compartment;

loading purchased items into the loading compartment over the plastic sheet material and causing portions of the plastic sheet to enter the interior of the loading compartment;

urging transverse edge portions of the plastic sheet into the first and second vertical slots and forming left and right vertical seams at the vertical slots exteriorly of the loading compartment; and heat sealing the left and right vertical seams to form a plastic package with the purchased items contained therewith.

13. The method of claim 12 and the further step of securing a portion of the plastic sheet material forwardly of the loading compartment and not securing the plastic sheet material rearwardly of the loading compartment.

14. The method of claim 12 and the further step of applying a spring-biased floor with the loading compartment and depressing the floor with the weight of the purchased items.

15. The method of claim 12 and the further step of severing the plastic sheet material rearwardly of the loading compartment upon completion of the loading operation.

16. The method of claim 12 and the further step of forming a finished plastic package about the loaded purchased items within the loading compartment.

17. The method of claim 16 and the further step of utilizing the loading compartment as a mold to shape the finished plastic package.

* * * * *